United States Patent [19]

Hillebrand

[11] Patent Number: 4,596,213

[45] Date of Patent: Jun. 24, 1986

[54] CAP RETAINER FOR HYDRAULIC LASH ADJUSTER ASSEMBLY

[75] Inventor: George A. Hillebrand, Battle Creek, Mich.

[73] Assignee: Eaton Corporation, Cleveland, Ohio

[21] Appl. No.: 746,707

[22] Filed: Jun. 20, 1985

[51] Int. Cl.[4] ..... F01L 1/24

[52] U.S. Cl. ..... 123/90.55; 123/90.37; 123/90.46

[58] Field of Search ..... 123/90.46, 90.56, 90.55, 123/90.87, 90.58, 90.37, 90.27

[56] References Cited

U.S. PATENT DOCUMENTS

| | | | |
|---|---|---|---|
| 3,358,660 | 12/1967 | Cornell | 123/90.55 |
| 4,184,464 | 1/1980 | Suihlik | 123/90.55 |
| 4,387,675 | 6/1983 | Hori et al. | 123/90.46 |

*Primary Examiner*—Ira S. Lazarus

*Attorney, Agent, or Firm*—C. H. Grace; A. E. Chrow; R. A. Johnston

[57] ABSTRACT

An improved lash adjuster assembly (100) of the type featuring a plunger member (20) reciprocally moveable within a bore (44) of a body member (2) and operable to reduce back lash in a drive train of an engine valve member wherein assembly (100) includes a retainer member (66) having a side wall (74) secured to body member (92) and having radially inwardly projecting section (76) having at least a portion thereof dimensionally adapted and of sufficient resilience to minimize impact between a shoulder (68) of plunger member (20) as well as enabling plunger member (20) to be removed from body member (2) without having to remove retainer member (66) from securement thereto in addition to enabling greater reciprocal travel of plunger member (20) relative body member (2) during operation of assembly (100) particularly due to softening of at least section (76) of retainer member (66) at elevated engine temperatures.

4 Claims, 6 Drawing Figures

CAP RETAINER FOR HYDRAULIC LASH ADJUSTER ASSEMBLY

INTRODUCTION

The present invention relates generally to an improved lash adjuster assembly for use in an internal combustion engine valve member drive train and more particularly where the assembly is of the hydraulic type having a reciprocating fluid operated plunger member operable to prevent back-lash in the valve member drive train.

BACKGROUND OF THE INVENTION

Lash adjuster assemblies for use in preventing back-lash in a valve member drive train driven by a rotary cam of an internal combustion engine have been known for many years. Such assemblies generally feature a plunger member that is operably connected to the valve member drive train and moveably disposed within an open-ended bore of body member mounted on the engine which, by means of reciprocating movement, is operable to cyclically pressurize fluid sych as engine oil to provide a pressurized fluid interface within the drive train operable to prevent back lash in the components of the drive train operably connecting the cam member to the valve member. The reciprocating action of the plunger member is generally initiated for a first type of installation where the rotary cam member driven by the engine is operatively engaged with the plunger member through a suitable drive train such as a pivoted rocker arm or the like while the body member is disposed within a closed bottom bore in the engine block and a second type where the body member is moveable reciprocally within an open-ended bore within an engine block where the body member itself is reciprocated by direct engagement with the rotating cam member.

The lash adjuster assemblies in both types of installations employ a retainer member (commonly called a cap retainer) secured to the body member and adapted to hold the plunger member within the body member bore without interfering with the reciprocating movement of the plunger member relative thereto.

The retainer member operates to contain the plunger member within the body member after assembly and prior to installation with a valve member drive train of an internal combustion engine. Typical body member retainer members are formed of stamped metal and have a central opening positioned over the open end of the body member in register with the plunger member. The plunger member is commonly provided with a shoulder adapted to abut the retainer member to limit its movement away from the body member to within a prescribed distance and to hold the plunger member to the body member during operation of the assembly. The body member will typically include a groove on the exterior thereof and an overlying portion of the retainer member is permanently plastically deformed for retention therewith.

An alternative approach has been the use of a snap or split ring action retainer member which embraces the outer body member surface.

Although widely commerically practiced, these approaches have a number of shortcomings. The metal retainers must be permanently deformed during assembly, a process requiring special tooling and process control to maintain acceptable tolerances. This form of mechanical attachment produces only point contact between the retainer member and the body member whereby the retaining forces are unequally distributed about the body member. Such unequal force distribution can distort the body, imparing plunger movement and interfit within the mating head bore. Because assembly is typically affected at room temperature, the clamping forces can be lost or very substantially reduced at elevated temperatures found during normal engine operating conditions whereby the retainer member can release from the body member and interfere with valve train operation. Split ring type retainers likewise apply uneven clamping forces and are prone to fatigue and early catastrophic failure. A further disadvantage of the deformed metal type retainer members is evident in lash adjuster assembly designs employing a bulbous or enlarged end portion of the plunger member which abuts a rocker arm to reduce per unit surface loading. The deformed metal approach is wholly unacceptable for this application, leaving only the split ring approach with its above-mentioned shortcomings. A further disadvantage of prior art metal retainer members arises from their physical size and the difficulty of adequately identifying a retainer member prior to assembly in a lash adjuster assembly. As is often the case, a manufacturer may produce many variations of a particular lash adjuster assembly, the retainer members of each which may be dimensionally distinct but visually indistinguishable. Problems arising from confusion of the identity of parts and misassembly is self-evident. An even further disadvantage of such prior art retainer members is that they characteristically provide a clearance about the plunger member through which fluid is liable to escape from the assembly.

Further, once assembled, it has heretofore been necessary to remove the retainer member from the body member before the plunger member could be removed for replacement or repair due to the underlying presence of the plunger member shoulder beneath the retainer member.

In view of the above, a need exists to provide an improved lash adjuster assembly employing a cap retainer member secured to a body member of the assembly and operative to retain movement of a reciprocating plunger member moveably disposed within a bore of a body member of the assembly to within a prescribed distance and to hold the plunger to the body member while enabling the plunger member to be removed from the body member bore without releasing the retainer member from the body member in addition to providing a fluid seal between the plunger member and the body member bore able to effectively reduce loss of fluid from the assembly.

SUMMARY OF THE INVENTION

Accordingly, it is an object of this invention to provide an improved fluid operated lash adjuster assembly operative to prevent back lash in the drive train of an internal combustion engine valve member.

It is another object of this invention to provide an improved fluid operated lash adjuster assembly having a plunger member reciprocally moveable within a bore of a body member mounted to an internal combustion engine block for preventing back lash in the drive train of a valve member of the engine wherein the assembly includes a retainer member secured to the body member and operative to enable reciprocal movement of the plunger member while holding the plunger member to the body member yet enable the plunger member to be removed from the body member without having to remove the retainer member from the body member in addition to providing an effective seal against loss of fluid from the assembly.

BRIEF DESCRIPTION OF SOME PREFERRED EMBODIMENTS

Figure 1:
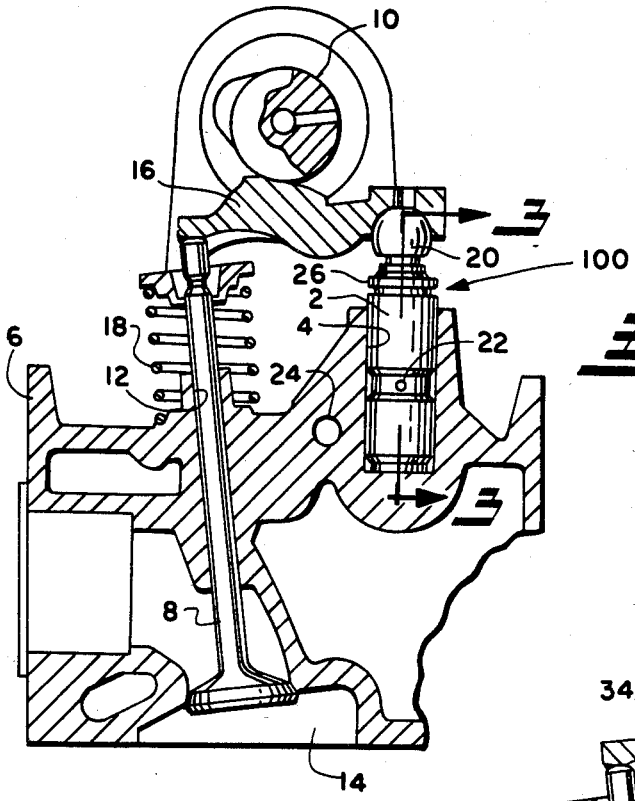
FIG. 1 shows a partial side-elevation cross-sectional view through an internal combustion engine block showing an application in which the body member of the body member of the improved lash adjuster assembly of the invention is relatively stationary and the plunger member is driven reciprocally by a rotary cam member driven by the engine.

FIG. 1 shows an application in which the body member 2 of an embodiment 100 of the improved lash adjuster assembly of the invention is disposed in a bore 4 in an internal combustion engine block 6 and operative to prevent back lash in the drive train of a valve member 8 driven by a rotary cam member 10 driven by the engine. Valve member 8 is reciprocally moveable within a bore 12 in engine block 6 for operation for example in synchronous relationship with the combustion cycle in a cylinder 14 of the engine. Cam member 10 operatively engages a pivotly mounted rocker arm 16 having one end held in biased engagement with valve member 8 by means of coiled spring 18 and an opposite end engaged with plunger member 20 of assembly 100 more fully described hereinafter with respect to FIGS. 3, 4, 5A and 5B. Body member 2 has a fluid passageway through a side wall for receiving fluid, commonly engine oil, from a fluid source 24 of the engine.

Assembly 100 is provided with a retainer member. hereinafter more fully described with respect to FIGS. 4, 5A and 5B, that is adapted to hold plunger member 20 to body member 2 yet enable assembly 100 to prevent back lash in the drive train of valve member 8 which in this case includes cam member 10 and rocker arm 16 while at the same time enabling plunger member 20 to be removed from body member 2 without having to remove retainer member 26 therefrom.

Rotation of cam member 10 causes rocker arm 16 to rock back and forth such that the end thereof engaged with valve member 8 moves valve member 8 reciprocally in synchronous relationship with cam member 10 while the opposite end of rocker arm 16 engaged with plunger member 20 moves plunger member 20 reciprocally to cyclically pressurize fluid within assembly 100 in the manner hereinafter described to provide a cyclically pressurized fluid interface adapted to prevent back lash in the drive train of valve member 8.

Figure 2:
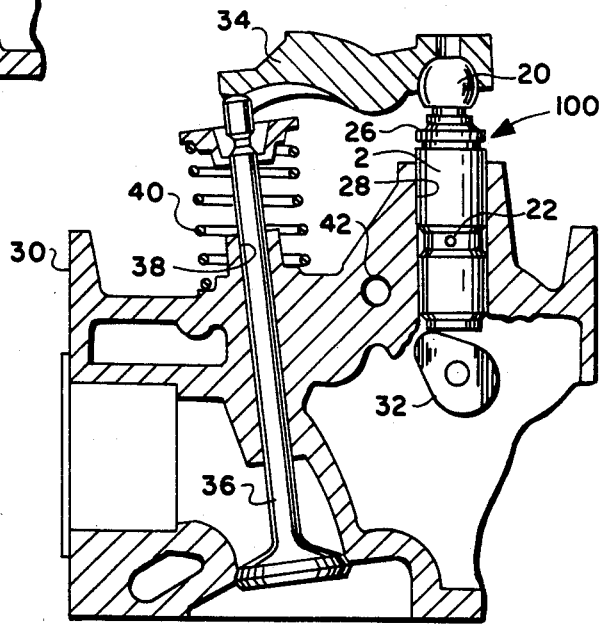
FIG. 2 shows a partial side-elevation cross-sectional view through an internal combustion engine block in which the body member of the improved lash adjuster of the invention is driven reciprocally by a rotary cam member driven by the engine.

FIG. 2 shows an example of another application of assembly 100 of FIG. 1 in which body member 2 is disposed reciprocally moveable within an open ended bore 28 in engine block 30 with a closed end of body member 2 engaged with a rotary cam member 32 driven by the engine and operative to cause body member 2 to move reciprocally within bore 28 in response to rotation thereof.

Plunger member 20 of assembly 100 is engaged with one end of a pivoted rocker arm 34 which has an opposite engaged with a valve member 36 moveable reciprocally within a bore 38 in engine block 30 and biased against rocker arm 34 by coil spring 40.

Assembly 100 is held in biased engagement with the opposite end of rocker arm 34 and receives fluid from a fluid source 42 through the fluid passageway 22 in body member 2 for the fluid operation thereof by cyclical pressurization of the fluid caused by reciprocating movement of body member 2 for providing a cyclically pressurized fluid interface operable to prevent back lash in the drive train for valve member 36 which in this instance includes cam member 32 and rocker arm 34. Assembly 100 in FIG. 2 includes retainer member 36, hereinafter more fully described, that is operative to hold plunger member 20 to body member 2 while enabling plunger member 20 to move reciprocally in the manner required to prevent back lash in the drive train of valve member 36 while enabling plunger member 20 to be removed from body member 2 without having to remove retainer member 26 therefrom.

Although the application for the assembly of the invention shown in FIGS. 1 and 2 respectively show the valve member drive train to include a rocker arm and a rotary cam member it is to be understood that the drive train may be of any type or kind that may include "push-rods" or the like well known to those skilled in the art and which enables a rotating cam member to operatively drive a valve member of an internal combustion engine in the manner desired.

Figure 3:
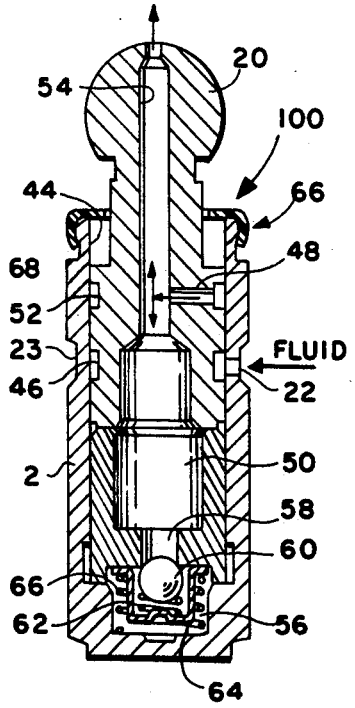
FIG. 3 shows a central side-elevation cross-sectional view through the embodiment of the improved lash adjuster assemblies used in the applications shown in FIGS. 1 and 2.

FIG. 3 shows a central cross-sectional view through assembly 100 used respectively in the applications of FIGS. 1 and 2. Body member 2 of assembly 100 preferably has a cylindrical configuration with an open ended bore 44 therewithin in which plunger member 20 is movably received. Body member 2 has a closed bottom end, as viewed in FIG. 3 and has a fluid passageway 22 through its side wall for receiving fluid into bore 44 from a fluid source.

Plunger member 20 preferably has an annular groove 46 in its outer surface that communicates with passageway 22 to enhance flow of fluid from passageway 22 through fluid passageway 48 which communicates with chamber 50 within plunger member 20 which provides a fluid resevoir for operation of assembly 100.

Body member 2 may itself be provided with an annular groove 23 in its outer surface adapted to enhance flow of the fluid from the fluid source through passageway 22. Likewise, plunger member 20 may have an annular groove 52 in its outer surface adapted to enhance flow of fluids from bore 44 through passageway 48 into chamber 50.

Although, the upper end of plunger member 20 is shown as having a bulbous shape, it may, of course, have any shape suitable for engaging the valve member drive train for which assembly 100 is being used to prevent back lash in the manner desired.

The generally flat closed end bottom of body member 2 as viewed in FIG. 3 may be used where body member 2 is disposed within a closed bottom bore of an engine block as, for example, as shown in FIG. 1 and in an open ended bore of the engine block where body member 2 is reciprocated by a cam member as, for example, shown in FIG. 2. In the latter case, the closed end of body member 2 may include roller means rotatably mounted on the closed end of body member 2 for engaging the cam member.

Passageway 48 through the side wall of plunger member 20 generally defines the upper limits of the fluid resevoir within chamber 50 when plunger member 20 is held in a vertical position.

Plunger member 20 is provided with a vent opening 54 communicating with chamber 50 to provide a vent for flow of excess fluid from the resevoir.

Assembly 100 is provided with a fluid pressurization chamber 56 below chamber 50 as viewed in FIG. 3. Chamber 56 is preferably provided by a bore (not referenced) in the bottom of plunger member 20 that communicates with bore 44 near the bottom thereof in body member 2.

An opening 58 between chamber 50 and 56 provides fluid communication between the fluid resevoir in chamber 50 and fluid pressurization chamber 56.

One-way valve means is provided for enabling pressurization chamber 56 to cyclically receive and pressurize fluid from the resevoir in chamber 50.

Although other suitable one way valve means may be employed, in assembly 100 the valve means comprises a ball check valve 60 that is urged against opening 50 by suitable resilient biasing means such as coiled spring 62 which is supported by bracket 64 which in turn is biased and biases bracket 64 and plunger member 20 away from the closed end of body member 2 by means of coiled spring 66.

The reciprocating movement of plunger member 20 causes ball check valve 60 to release from opening 58 during the upstroke of plunger member 20, as viewed in FIG. 3, sufficiently to let fluid flow from the resevoir in chamber 50 into pressurization chamber 56 and, on the downstroke of plunger member 20 to be urged against opening 58 sufficiently to provide a fluid type seal enabling pressurization of the fluid in chamber 56. The cyclical fluid pressurization in chamber 56 provides the cyclically pressurized fluid interface operative to prevent back lash in the valve member drive train operatively employing assembly 100.

The means by which the assembly of the invention is improved is hereinafter described with respect to retainer member 66 shown in FIG. 3 and described more fully hereinafter with respect to FIGS. 4, 5A nd 5B. Plunger member 20 is provided with an annular shoulder 68 or other suitable stop positioned to enable retainer member 66 to hold plunger member 20 within bore 44 of body member 2 after assembly and yet enable plunger member 20 to move reciprocally relative to body member 2 in the manner desired for operation of the assembly.

Figure 4:
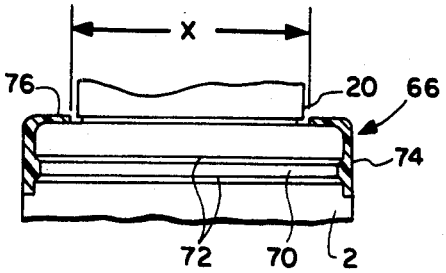
FIG. 4 shows a partial side elevation view of an embodiment of a retainer member used to provide the improved lash adjuster assembly of the invention.

In FIG. 4, retainer member 66 is secured to body member 2 preferably by having its side wall 74 circumferentially secured in annular groove 70 in the outer surface of body member 2 which may be provided with facing side walls 72 which taper radially outwardly away from each other from the bottom of groove 70.

A section 76 of retainer member 66 extends radially inwardly from side wall 74 towards plunger member 20 for a distance sufficient to insure that section 76 engages shoulder 68 after assembly. Preferably section 76 is provided with a circular opening axially aligned with the longitudinal central axis of plunger member 20 having a diameter "x" that is smaller than the diameter of shoulder 68 and slightly larger than the diameter of body member 20 in a region between shoulder 68 and the exposed end of body member 2 that extends along body member 20 for a distance sufficient to enable the amount of reciprocal movement desired for plunger member 20.

Section 76 of retainer member 66 may however extend radially inwardly even further and actually engage the dimensionally reduced region of plunger member 20 adjacent and between shoulder 68 and the exposed end of plunger member 20 provided it does not interfere in the reciprocal movement desired for plunger member 20.

Figure 5A:
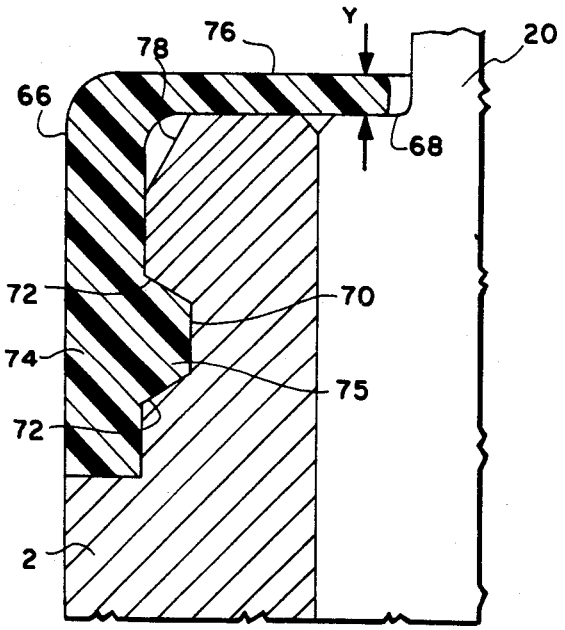
FIGS. 5A and 5B, respectively, show partial side elevation cross-sectional views of coaction between the plunger and retainer members for two different positions of the plunger member of an embodiment of the improved lash adjuster assembly of the invention.

In FIG. 5A, plunger member 20 is shown positioned relative body member 2 such that section 76 of retainer member 68 is in engaged relationship with shoulder 68 of plunger member 20. Side wall 74 of retainer member 66 is provided with an internal annular rib 75 facing and extending radially inwardly securing retainer member 66 to groove 70 in the outer surface of body member 2. Annular rib 75 preferably is provided wtih side walls facing away from each other which respectively taper so as to substantially match tapered side walls 72 of groove 70.

The corner of body member 2 adjacent the junction of section 76 and side wall 74 of retainer member 66 is preferably tapered such as referenced as 78 to prevent body member 2 from damaging retainer member 66 at that juncture.

Retainer member 66 is made from a resilient material compatible with the fluid involved and operable at the temperatures to which it is exposed at engine operating conditions. Section 76 of member 76 has a thickness "y" such that the combination thereof enables retainer member 66 to hold plunger member 20 within bore 44 of body member 2 after assembly and is operative to limit reciprocal movement of plunger member 20 during operation of the assembly without interfering with the amount of reciprocal movement desired yet enables plunger member 20 to be removed from body member 2 during separation of the assembly from the drive train or external of the drive train for replacement or repair without having to remove retainer member 66 from securement to body member 2.

Figure 5B:
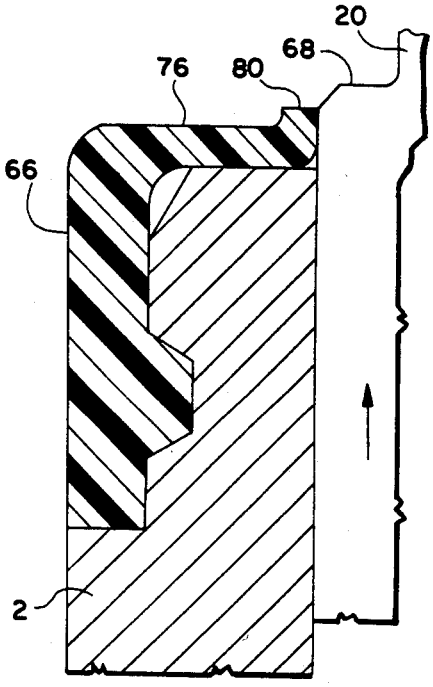

More particularly, as shown in FIG. 5B, the combination of resilience and thickness of section 76 enables one to move member 20 upwardly such that end 80 of section 76 adjacent plunger member 20 flexes sufficiently to enable shoulder 68 to move upwardly past section 76 enabling removal of plunger member 20 from bore 44 of body member 2.

The combination of dimensional adaption and resiliency of section 76 at least in a region adjacent plunger member 20 sufficient to enable its removal from bore 44 of body member 2 provides a substantial improvement to the assembly of the invention for such can be accomplished without having to remove retainer member 66 from securement with body member 2 whereas prior art retainer members had to be first removed from the body member before the plunger member could be removed which often requires specialized tools.

It has been further discovered that the resiliency of retainer member 66, at least in the region of section 76 adjacent plunger member 20, avoids severe impact under operating conditions between shoulder 68 and prior-art metallic type retainers heretofore used. It has even further been discovered that plunger member of a lash adjuster assembly using the resilient retainer member of the invention is able to protrude past the initial assembled position of section 76 relative shoulder 68 due to softening of at least section 76 of the retainer member at high engine speeds and engine operating temperatures which effectively increases the reciprocal travel distance of plunger member 20 under engine operating conditions without separation from the drive train yet enables the retainer and plunger to return to their initial positions relative each other as the engine speed is reduced and the temperature cools down.

It has been found that the retainer member for the improved fluid operated lash adjuster assembly of the invention can be advantageously made from a suitably flexible nylon material particularly a flexible type 6/6 nylon. It has further been found that a thickness of about 0.029 inch to about 0.036 for section 76 made from a suitably flexible nylon 6/6 material, at least in a region adjacent body member 20 sufficient to enable the plunger member to be removed from the body member of the assembly is effective to enable the plunger member to be removed from body member without having to remove the retainer member from the body member of the assembly as well as enable the plunger member to effectively increase its reciprocal travel distance at higher engine speeds and temperatures as previously described.

Although the retainer member of the improved assembly of the invention may be secured to the body member in any manner suitable to permit the assembly to operate in the manner desired, a preferred method is to mold the retainer in place where the retainer member is made form a moldable material such as nylon 6/6 or, in the event the retainer member is sufficiently stretchable, to stretch the side walls of the retainer member radially outwardly such that it is able to slip over the open end of the body member and, upon release, compress radially inwardly against the outer surface of the body member with sufficient force to enable the assembly to operate in the manner desired.

What is claimed is:

1. An improved fluid operated lash adjuster assembly for preventing back lash in a drive train of an internal combustion engine valve member, said assembly including a body member mounted on the engine and having a bore therewithin providing the body member with an open end and a closed end, means for receiving the fluid into said bore from a fluid source, a plunger member disposed for reciprocal movement in said body member bore having a fluid resevoir therewithin, means for receiving the fluid from the body member bore into said fluid resevoir, means for cyclically pressurizing fluid from the resevoir in synchronous relationship to rotation of a rotary cam member driven by the engine to provide a cyclical pressurized fluid interface between the plunger member and the body member in conjunction with reciprocal movement of the plunger member within the body member bore operative to prevent back lash in the valve member drive train, and a retainer member having a side wall provided with means on an inner surface thereof facing towards the body member to secure the retainer member to the body member adjacent the open end thereof and having a section hereof projecting from said side wall radially inwardly towards the plunger member for a distance sufficient to enable said section to engage a shoulder on the plunger member and hold plunger member within the body member bore without interfering with the reciprocal movement thereof, wherein the improvement is characterized by said retainer member being made from a material compatible with said fluid and said radial inwardly projecting section thereof dimensionally adapted and having sufficient resilience, at least for a distance adjacent the plunger member, to enable the plunger member to be removed from the body member without having to release the retainer member from securement with the body member.

2. The improved lash adjuster assembly of claim 1 wherein the retainer member material is a resilient nylon material.

3. The improved lash adjuster assembly of claim 2 wherein the nylon material is a nylon 6/6 material.

4. The improved lash adjuster assembly of claim 1 wherein the means for securing the retainer member to said body member comprises an annular groove in the outer surface of the body member adjacent the open end thereof and said retainer member side wall is provided with an annular rib facing and adapted to engage said body member annular groove and secure the retainer member thereto.

* * * * *